US009044051B1

(12) United States Patent
Rydman et al.

(10) Patent No.: US 9,044,051 B1
(45) Date of Patent: Jun. 2, 2015

(54) SLIMMING PANT OR SKIRT FOR A WOMAN

(71) Applicants: Rebecca Taylor Rydman, Salt Lake City, UT (US); Kristy Olsen, Sandy, UT (US)

(72) Inventors: Rebecca Taylor Rydman, Salt Lake City, UT (US); Kristy Olsen, Sandy, UT (US)

(73) Assignee: Lilac Maternity, LLC, Sandy, UT (US)

( * ) Notice: Subject to any disclaimer, the term of this patent is extended or adjusted under 35 U.S.C. 154(b) by 0 days.

(21) Appl. No.: 13/891,417

(22) Filed: May 10, 2013

Related U.S. Application Data

(60) Provisional application No. 61/645,158, filed on May 10, 2012.

(51) Int. Cl.
*A41C 1/08* (2006.01)
*A41C 1/12* (2006.01)
*A41D 1/06* (2006.01)

(52) U.S. Cl.
CPC .... *A41C 1/12* (2013.01); *A41D 1/06* (2013.01)

(58) Field of Classification Search
CPC ..... A41C 1/00; A41C 1/08; A41D 1/00; A41D 1/06; A41D 1/22
USPC ..... 2/226, 227, 220, 221, 237, 236
See application file for complete search history.

(56) References Cited

U.S. PATENT DOCUMENTS

| | | | | |
|---|---|---|---|---|
| 4,506,390 | A | 3/1985 | Stern | |
| D583,529 | S | 12/2008 | Gardner, III | |
| 7,516,499 | B2 | 4/2009 | Gardner, III | |
| D625,487 | S | 10/2010 | Hendrickson | |
| 7,814,575 | B2 | 10/2010 | Hendrickson | |
| D627,133 | S | 11/2010 | Hendrickson | |
| D630,410 | S | 1/2011 | Hendrickson | |
| 7,878,880 | B2 | 2/2011 | Hendrickson | |
| 7,878,881 | B2 | 2/2011 | Hendrickson | |
| 7,900,276 | B2 | 3/2011 | Hendrickson | |
| D644,003 | S | 8/2011 | Hendrickson | |
| 7,996,919 | B2 | 8/2011 | Gardner, III | |
| 8,074,298 | B2 * | 12/2011 | Davenport | 2/227 |
| 8,075,369 | B2 | 12/2011 | Hendrickson | |
| RE43,531 | E | 7/2012 | Hendrickson | |
| 8,226,452 | B2 | 7/2012 | Hendrickson | |
| RE43,563 | E | 8/2012 | Hendrickson | |
| 2004/0210987 | A1 * | 10/2004 | Carney | 2/236 |
| 2006/0010571 | A1 * | 1/2006 | Oakley | 2/227 |
| 2008/0022434 | A1 | 1/2008 | Adelman | |
| 2010/0068971 | A1 | 3/2010 | Hendrickson | |
| 2011/0219513 | A1 | 9/2011 | Hendrickson | |

OTHER PUBLICATIONS www.target.com; "Liz Lange for Target Maternity Beige-Band Bootcut Jeans"; Oct. 19, 2012.
www.target.com; "Liz Lange for Target Maternity Extended-Sizes Flare Jeans"; Oct. 19, 2012.
www.nydj.com/NYDJ-fit.html; "Look, feel and buy one size smaller"; Jul. 16, 2013.

* cited by examiner

*Primary Examiner* — Gloria Hale
(74) *Attorney, Agent, or Firm* — Austin Rapp & Hardman

(57) ABSTRACT

A pant (or other woman's bottom, such as a pair of shorts, a skirt, Capri pants, etc.) includes an attached "control top panel." This control top SHAPEWEAR panel is designed to help smooth, trim and shape the woman's mid-section or torso area, thereby making her figure more shapely, trim and/or attractive, as well as physically measuring smaller in circumference where the panel is compressing. The control top panel is attached to the top of the pants and covers the woman's mid-section and/or areas of the torso.

1 Claim, 4 Drawing Sheets

SLIMMING PANT OR SKIRT FOR A WOMAN

CROSS REFERENCE TO RELATED APPLICATION

The present application claims the benefit of U.S. Provisional Patent Application Ser. No. 61/645,158 filed on May 10, 2012. This prior patent application is expressly incorporated herein by reference.

TECHNICAL FIELD

The present invention relates to the field of women's clothing. More specifically, the present invention relates to a compression garment (herein referred to as a "panel" or "band", but may include any shape wear for the upper body attached to a bottom garment) attached to women's pants, women's skirts or other women's clothing worn on women's legs.

BACKGROUND

Women's shapewear is a growing industry. Women are constantly looking for new styles and new clothing that will help them look and feel their best. Particularly, many women would like to wear clothes that make their bodies look "slimmer" and healthier. Accordingly, there is a need in the art for a new type of woman's bottom that is not intended as strictly an undergarment (e.g., woman's pant, woman's skirt, women's shorts, etc.) that may be used to help the woman look slimmer.

SUMMARY

The present embodiments relate to a pant (or other woman's bottom, such as a pair of shorts, a skirt, Capri pants, etc.) with an attached "control top panel." This compression panel is designed to help smooth, trim and shape the woman's mid-section—thereby making her figure more shapely, trim and/or attractive.

The woman's bottom is a "pull-on" style pant made of fabric on the bottom (such as denim, cotton, nylon, etc.) and has a reinforcement panel (control panel) attached to the top of the waistband of the pant, skirt, etc. This reinforcement panel creates compression on the woman's belly, sides and back.

DETAILED DESCRIPTION

Figure 1:
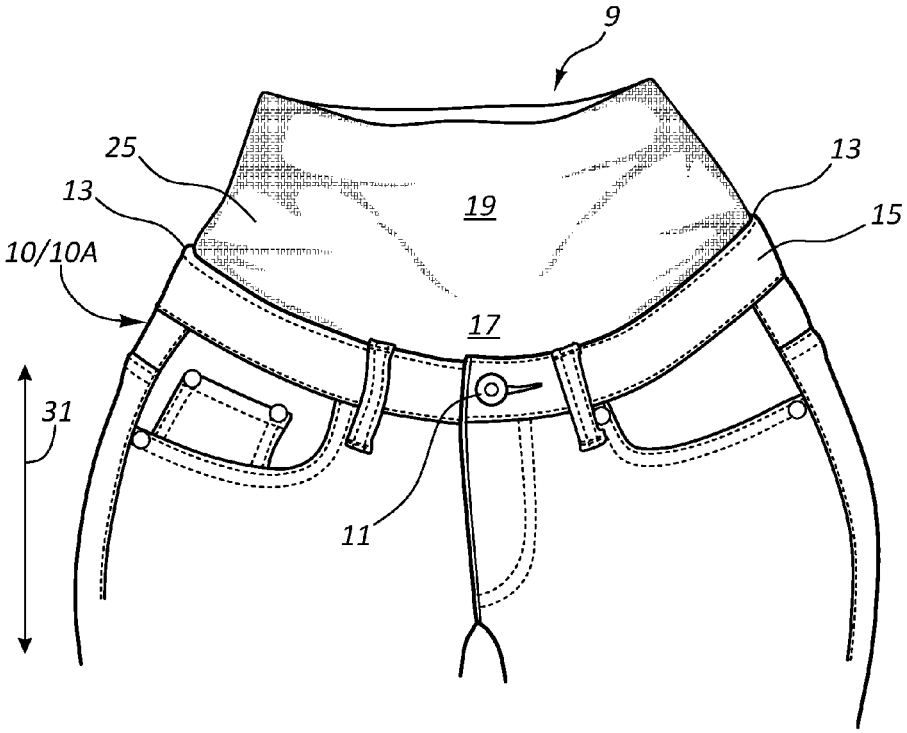
FIG. 1 is perspective view of a sample of a pant according to the present embodiments.

Referring now to FIG. 1, a new type of woman's bottom is shown. In the drawing of FIG. 1, the bottom 10 comprises a pant 10*a*, such as a denim pant. However, those skilled in the art will appreciate that other different types of clothing may be used as the "bottom" 10, such as a skirt, shorts, non-denim pants, Capri pants, etc. As shown in FIG. 1, the pant 10*a* is designed such that a woman may place her legs in the pant-legs, pull the pants up, and secure the pants around her waist. The pant 10 includes a waistband 15 that is designed to fit around the woman's waist.

The pant 10*a* may also include a control top panel 25 that is attached to the top of the waistband 15. This control top panel 25 may be made of nylon or another type of "compressing" fabric. More specifically, the control top panel 25 is designed such that it will "compress"—e.g., create pressure on the woman's stomach, sides and back, thereby shaping the woman's belly/mid-section and making the woman look more skinny, slim, etc. At the top of the control panel 25 may be a silicone strip 35 (shown in FIG. 2) or other similar feature that is designed to hold the pant up (although this silicone strip is optional and may not be present in all embodiments).

Figure 2:
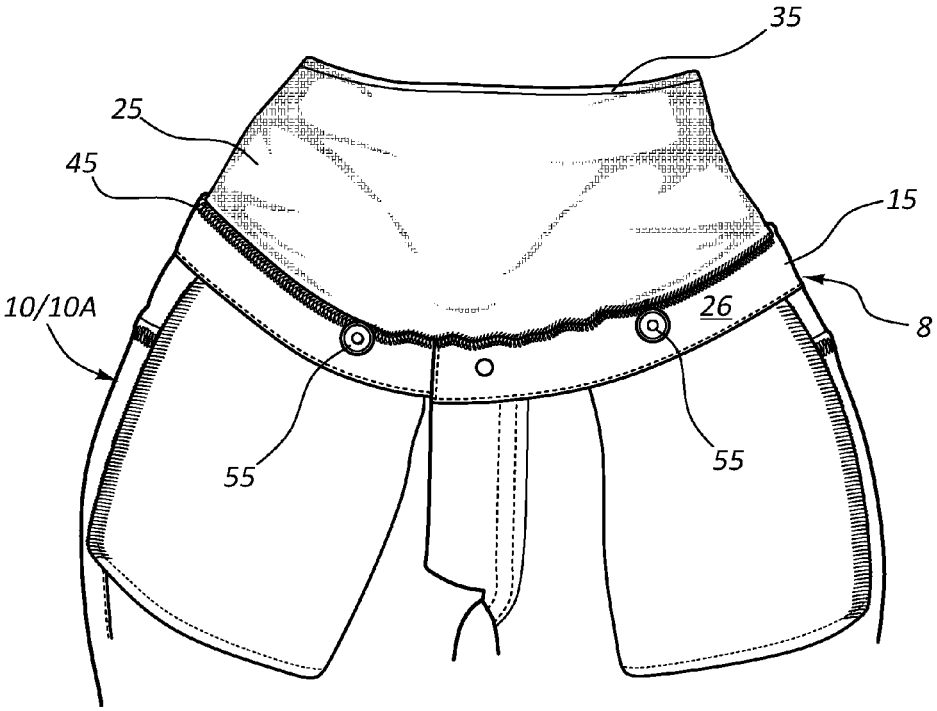
FIG. 2 is a perspective view of the pant of FIG. 1, that has been folded "inside-out," thereby showing the interior of the pant.

Referring now to FIG. 2, the pants 10*a* of FIG. 1 are shown. However, in the embodiment of FIG. 2, the pants 10*a* have been folded "inside-out" so that the seams, etc. are visible. The pants 10*a* have top portion 8. As can be seen in FIG. 2, the control top panel 25 may be sewn or otherwise attached to the pant 10*a* (e.g., the top portion 8). Further, on the inside of the pant's waistband 15, there may be a hidden elastic band 26 with adjusters 55 that allow the woman to tighten or loosen the waistband 15, as is known in the art. (The waistband 15 is part of the top portion 8.)

Figure 3:
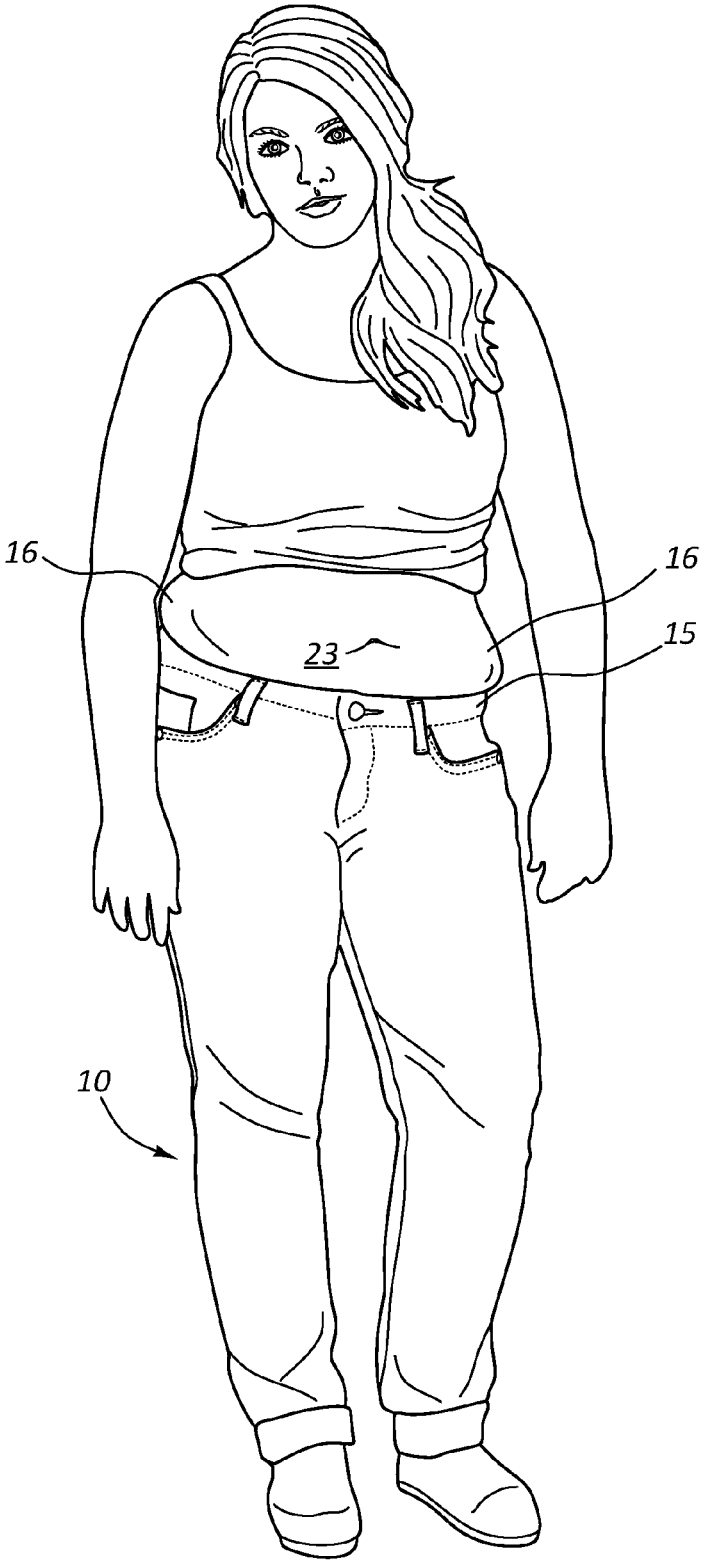
FIG. 3 is a perspective view of a woman wearing another type of pant.
Figure 4:
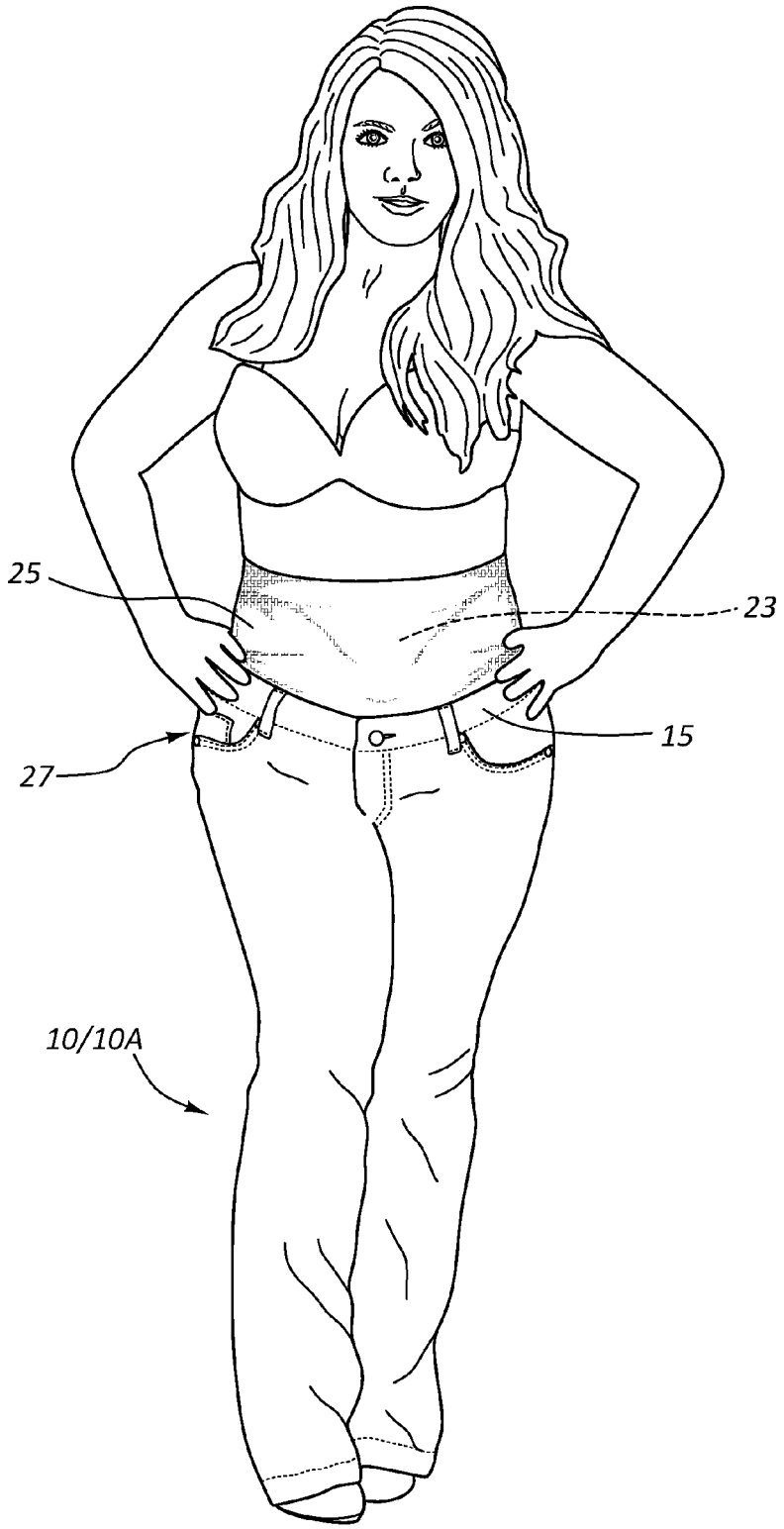
FIG. 4 is a perspective view of a woman wearing the pant of FIG. 1.

FIGS. 3 and 4 show perspective view of a woman wearing different types of pants. (These figures are similar to the photographs shown in U.S. Provisional Patent Application Ser. No. 61/645,158.) FIG. 3 shows a drawing of a woman wearing a different type of pant, whereas FIG. 4 shows a drawing of a woman wearing an embodiment of the slimming pants 10*a* according to the present embodiments. FIG. 3 the woman wearing regular jeans, e.g., jeans that do not include a control top panel. However, in FIG. 4, the woman has been placed in the pants 10*a*. The woman's mid-section/stomach 23 appears and measures much slimmer in FIG. 4, mainly because the compression that occurs from the control top panel 25 exerts a force on the woman's body, back, stomach, etc. that shapes the woman's body into a slimmer, trimmer design. On average, a woman may measure one pant size (1 inches to 2 inches) smaller in circumference at the location of compression as a result of wearing the panel 25. Woman of larger sizes, such as the woman shown in FIGS. 3 and 4, may measure more than 2 inches smaller as a result of wearing the pant 10*a*. Accordingly, the woman wearing the pant 10*a* will feel more attractive, slimmer, more confident in her look, etc.

Although FIGS. 3 and 4 relate to a "pant" for a woman, those skilled in the art will appreciate that the control top panel 25 could easily be added to other articles of clothing, such as skirts, shorts, Capri pants, etc.

Figure 5A:
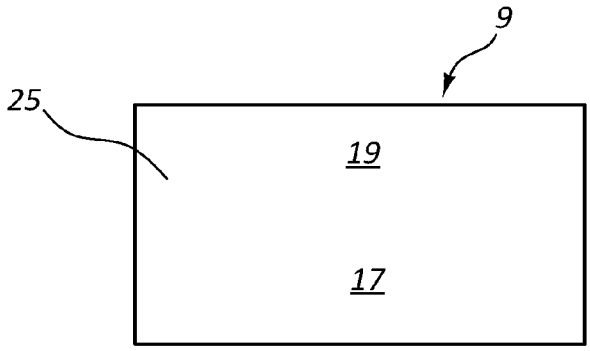
FIGS. 5A and 5B show the panel detached and then attached to the pants.
Figure 5B:
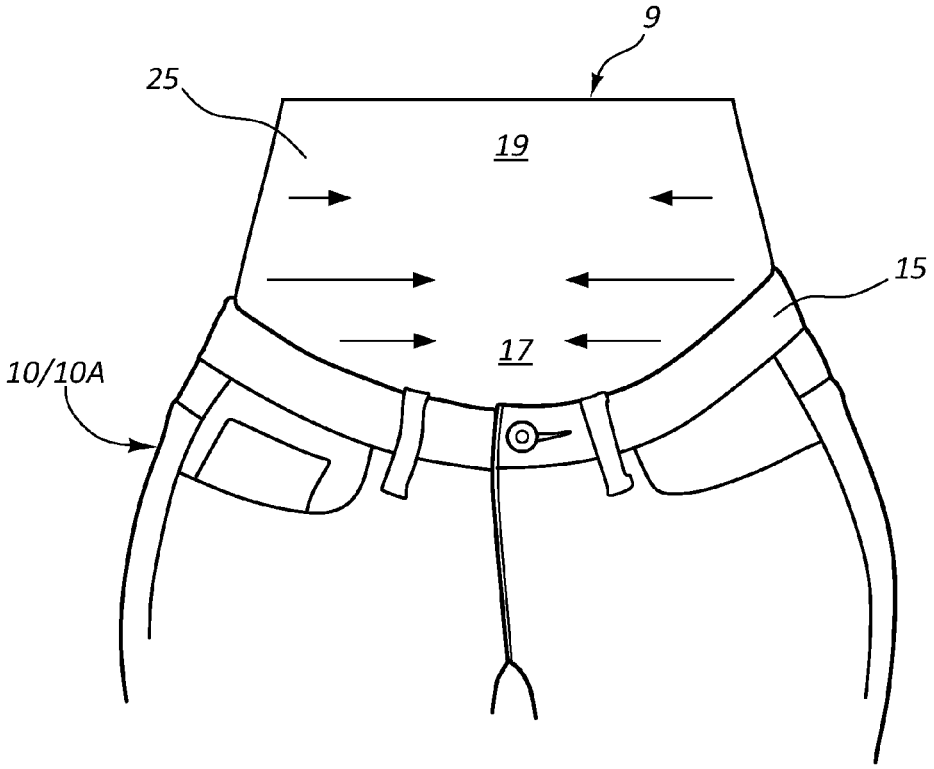

Referring now to FIGS. 5A and 5B, the panel 25 is shown (in FIG. 5A) as separate from the pant 10*a*, whereas the panel 25 is added to the pant 10*a* in FIG. 5B. It is noted that the panel 25, as seen in FIG. 5A, is rectangular in shape. (In other words, the panel 25 is tubular.) However, when attached to the pant 10*a*, the panel 25 appears to have a tapered profile. The rectangular shape of the panel 25 creates a tapered vertical compression which smoothly eases from the hip area (the wider area of the woman where the panel 25 meets the garment waistband) upward to the narrower point of the torso. This eliminates the potential of having excess skin and fat being pushed over the top of the panel opening 9. By stretching the rectangular panel 25 more at the bottom (e.g., at the point where it joins the garment), there is less compression at the opening 9, but the woman's stomach will be neatly compressed across the entire longitudinal length of the panel 25.

However, as shown in FIG. 5B, when added to the bottom, the rectangular panel 25 does appear to take on a tapered shape (e.g., being narrower at the point near the opening 9.)

FIGS. 1 and 2 shows this tapered profile of the panel 25. In the embodiment of FIG. 1, the top portion 8 of the pants 10*a* is generally parabolic in shape (e.g., is concave upwards in shape). This means that the portion proximate the button 11 is vertically lower than the edges 13 of the pants 10*a*. Likewise, when attached and stretched the bottom portion 17 of the rectangular control top panel 25 is similarly parabolic in shape such that the portion proximate the button 11 is vertically lower than the portion proximate the edges 13. In other words, when stretched and attached, the bottom 17 of the rectangular control top panel 25 is sewn so that it corresponds to the top 8 of the pants 10*a*. Many women want to have an "hourglass figure", which is larger near the woman's chest and hips, but smaller in the middle near the woman's waistline. The purpose of having this taper when the panel is attached is for the control top panel 25 is to foster this hourglass shape in the woman's body. The control top panel 25 is designed to pull the woman's belly (stomach) inward, thereby helping it achieve an hourglass figure. In order to further this hourglass shape, the circumference of the top of the control panel 25, when attached, is narrower, so that this portion of the woman's figure is also compressed, thereby further shaping the woman's figure.

The way in which the control top panel 25 works is illustrated by the above-recited provisional patent. The control top panel 25 is a "compression" panel made of nylon or another compressing fabric. The compression control top panel 25 works in a way that will push in the excess skin and stomach, thereby making a tighter and smaller midsection area. (The excess skin and fat on a woman is shown in FIG. 3 as element 16.) Thus, the control top panel prevents the softer excess skin from sagging over the waistband or the edges 13 of the pants 10*a*. Further, the control top panel 10*a* also controls the midsection of the woman's stomach 23 by sucking it in with the compression nylon. The nylon fabric material is attached onto the pants 10*a* (such as denim pants) so that it is all one piece, allowing there to be no excess skin 16 or over hang over the denim waistband that is common in regular pairs of jeans. Generally, the woman wearing the pants 10*a* with the control top panel 25 will feel a "compressive" force being applied to her stomach, so that the woman will know that the pants 10*a* are indeed "slimming" her body.

It should be noted that the control top panel 25 is not intended and should not be in anyway used for maternity pants. (Maternity pants are designed to expand to accommodate the woman's belly increasing in size during pregnancy.) Rather, the control top panel 25 is a compression feature and should only be used to bring in the waist rather than allow the waist to expand and grow. The control top panel 25 is a product that helps women appear and actually measure immediately smaller and have a tighter, slimmer waistline.

Referring now to FIG. 1-5B collectively, the embodiments of the present invention will be described in greater detail. As noted herein, the present embodiments relate to a woman's bottom garment, and more specifically, an item of women's clothing that is designed to cover the hip 27 and midsection (tummy) 23 of a woman. This item of clothing 10 may be a bottom such as a skirt, a pant, etc.

A control top panel 25, which may also be referred to as a "narrowing" panel 25, is added to the pant 10. The panel 25 is attached to the waistband 15 via stitching or other means including hook and eye clasps, VELCRO®, zippers, etc. It should be noted that embodiments may be constructed in which the panel 25 may be removed, changed out for a different color, etc. The panel 25 (and more specifically, all or at least half of the panel 25) is made of a second material such as a nylon (or other similar materials). This material that is used for the panel may be different than the denim that is used for the bottom. In other words, there are two materials used on the pant, namely denim or woven fabric for the pant and a one-piece panel 25 made of nylon or another compression material such as nylon-spandex combinations.

The panel 25 defines an opening 9 that is located at the most remote portion of the panel (when measured from the waistband 15) in an axial direction 31. When the panel 25 is attached, it appears in a "tapered" form, such that it looks as if the panel 25 decreases in circumference in the axial direction 31 away from the waistband 15.

The purpose of the panel 25 is to exert an increasingly narrow radially inward force (e.g., to push the midsection 23 of the woman inward) so that she looks and measures smaller than her size before she put on the pant. The panel exerts an increasing narrow radially inward force in the axial 31 direction away from the waistband 15 in response to a radially outward force applied by the woman's body.

It should be noted that a sample group of women were measured with and without the compression panel and results showed and average loss of one to two inches at the circumference of their midsection while wearing the panel. Obviously, results may vary depending upon the particular woman being measured because every body shape is different.

What is claimed is:

1. A method of making an item of clothing designed for covering at least a portion of a hip and midsection, or a hip and torso region of a person, the item comprising:

providing a compression panel having a tubular shape, the tubular shape of the compression panel defining a first opening and a second opening, the second opening being opposite the first opening, the compression panel having a first portion adjacent to the first opening, the first portion having a first circumference, the compression panel having a second portion adjacent to the second opening, the second portion having a second circumference, the compression panel comprising a first material and having a one-piece structure;

providing a waistband comprising a portion of the item of clothing, the waistband having a third circumference, the waistband being made of a second material different from the first material, the second material being less resilient than the first material, the third circumference being greater than the second circumference when each of the compression panel and the waistband are not deformed by outside forces; and stretching the second portion of the compression panel and attaching the second portion of the compression panel to the waistband such that the second portion is secured to the waistband along the second portion thereby increasing the second circumference such that the second circumference is greater than the first circumference and such that the compression panel comprises a tapered shape that is increasingly narrow in an axial direction away from the waistband when the compression panel and waistband are attached to each other and are not deformed by outside forces, and wherein, before the stretching and the attachment of the compression panel to the waistband, the first circumference and the second circumference are equal such that the compression panel has a rectangular shape when the compression panel is not deformed by outside forces.

* * * * *